US006145969A

United States Patent [19]

Tamano

[11] Patent Number: 6,145,969

[45] Date of Patent: Nov. 14, 2000

[54] METHOD FOR REFILLING AN INK CARTRIDGE

[75] Inventor: Hisami Tamano, Chatsworth, Calif.

[73] Assignee: Mitsubishi Pencil Corporation of America, Chatsworth, Calif.

[21] Appl. No.: 09/309,421

[22] Filed: May 11, 1999

Related U.S. Application Data

[62] Division of application No. 08/910,325, Aug. 13, 1997.

[51] Int. Cl.[7] ..... B41J 2/175

[52] U.S. Cl. ..... 347/85

[58] Field of Search ..... 347/85, 86, 87

[56] References Cited

U.S. PATENT DOCUMENTS 5,572,852 11/1996 Crystal et al. ..... 53/428

5,751,320 5/1998 Scheffelin et al. ..... 347/85

5,969,734 10/1999 Tamano ..... 347/85

*Primary Examiner*—N. Le

*Assistant Examiner*—Michael Nghiem

*Attorney, Agent, or Firm*—Koda & Androlia

[57] ABSTRACT

An ink refilling method for an ink cartridge which is provided therein with a spring assembly for generating a negative pressure inside the cartridge being refilled with ink while applying a compression onto the spring assembly. In this method, the compression is removed so as to allow the spring assembly to expand and to generate the negative pressure. The application and removal of the compression is provided by a pressure tool that has an elastic metal strip bent so as to press the spring assembly; and the ink refilling is accomplished using an opening tool for making an access to the inside of the ink cartridge and an ink refilling adapter for introducing ink from an ink supply into the ink cartridge, which form an ink refilling kit along with the pressure tool.

6 Claims, 5 Drawing Sheets

METHOD FOR REFILLING AN INK CARTRIDGE

This is a Divisional Application of application Ser. No. 08/910,325, filed Aug. 13, 1997.

BACKGROUND OF THE INVENTION

1. Field of the Invention

The present invention relates to a method and apparatus for refilling an ink cartridge and more particularly to a method, apparatus and a kit for refilling an ink-jet cartridge that has therein a spring for maintaining negative pressure on the ink in the ink cartridge.

2. Prior Art

In order to protect the environment and save energy, it is today's common practice to reuse used printer ink cartridges and not just discard them. In other words, when an ink cartridge (merely called "cartridge") designed for use in computer printers, particularly in ink-jet printers, runs out of ink, the cartridge is refilled with ink so that the thus refilled cartridge can be installed back in the printers for further use.

There are many different types of cartridges that are currently manufactured and marketed. One type of cartridge includes a spring means installed inside the ink reservoir provided in the cartridge.

More specifically, as shown in FIG. 9 which shows an interior of a typical ink cartridge that has therein a spring means, the cartridge 100 is comprised of a main casing 102 and two side coverings 102*a* and 102*b* that fit on the main casing 102 to form a hollow enclosure, and an ink reservoir 110 is installed therein. The cartridge 100 further has a head part 100' and other elements (those elements, however, will not be described since they are not particularly relevant to the present invention). The ink reservoir 110 comprises a flexible reservoir bag 110' which is made of, for instance, plastic or foil, two opposed side plates 112*a* and 112*b* installed in the reservoir bag 110', and a spring means 114 provided between the side plates 112*a* and 112*b*. The spring means 114 is in substantially an oval shape obtained by a pair of metal sheets 114*a* and 114*b* which are respectively adhered to the side plates 112*a* and 112*b*. When a pressing force is applied in a direction of arrow P so as to push the pair of the metal sheets 114*a* and 114*b* towards each other, the spring means 114 is compressed and changes its shape as shown by a dotted line; and when such a compression force is released, the spring means 114 is brought back to its original shape as shown by a solid line.

FIG. 10 shows an exterior of the cartridge 100. The cartridge 100 has a head part 100' and an ink filling aperture 120 that communicates with the ink reservoir 110. The ink filling aperture 120 is closed by a metal ball 122 which is covered by a closing seal 124. In addition, interior access slits or openings 130 are formed between the main casing 102 and the side coverings 102*a* and 102*b*. These interior access slits or openings 130 are used so that both ends of an ink amount indicating tape (not shown) are inserted thereinto. The interior access slits 130 and the ink amount indicating tape are covered by a covering seal 140.

In this cartridge 100, the spring means 114 is provided so as to generate and keep a negative pressure on the ink stored in the ink reservoir 110. More specifically, the ink stored inside the ink reservoir 110 generates pressure that is applied to not only the ink reservoir 110 but also the head part 100' of the cartridge through which the ink is supplied from the cartridge 100 to a printer. Thus, the ink tends to flow out of the cartridge 100 through the head part 100' by its own pressure. The spring means 114 prevents such a flow out of the ink. In other words, the spring means 114 produces an expanding force in the direction in which the metal sheets 114*a* and 114*b* are set apart from each other along the smaller diameter of the oval shape (or in the direction opposite from the arrow P in FIG. 9), and this expanding force generates a negative pressure inside the ink reservoir 110 which is smaller than the atmospheric pressure. As a result, the ink inside the ink reservoir 110 is prevented from leaking out through the head part 100' of the cartridge 100 since it is kept under the negative pressure.

Generally, currently marketed ink refilling devices are used such that: the ink filling aperture of the cartridge, which was used for initially filling the ink in the cartridge and sealed with a metal ball, is first opened by removing the metal ball; the refilling device is coupled to the thus opened ink filling aperture; and then, an ink tube is set in and coupled to the refilling device, thus letting the ink in the ink tube flow into the ink reservoir of the cartridge forcibly or by way of gravity. Upon completion of this ink filling process, the refilling device is removed, the ink filling aperture is closed by a closing plug, and then the refilled cartridge is put back in the printer.

Accordingly, when such an ink refilling device is used for the cartridge that includes a spring means as described above and shown in FIGS. 9 and 10, the spring means 114, that has been in the shape shown by the dotted lines in FIG. 9 after the ink in the ink reservoir 110 was used up, expands until its further expansion is restrained by the inner surfaces of the side coverings 102*a* and 102*b* of the cartridge 100 by way of the exterior air comes into the ink reservoir 110 upon the removal of the metal ball 122 from the ink filling aperture 120; and after the completion of the ink refill process, there is no way to bring the spring means 114 to be compressed and then let it expand to produce a negative pressure inside the ink reservoir 110. As a result, the refilled ink leaks out through the head part 100' of the cartridge 100, occasionally damaging the print head of the printer.

In short, the existing ink refilling device cannot provide an ink cartridge with a negative pressure inside the ink reservoir.

SUMMARY OF THE INVENTION

Accordingly, the object of the present invention is to provide an ink refill method and apparatus which restores the spring force to the spring means provided inside an ink cartridge upon the completion of the ink refill process so that a negative pressure is created inside the ink reservoir in the refilled cartridge, thus preventing ink leakage.

The object is accomplished by a unique structure for a pressure tool that comprises a base body having a thin end and a pressing means provided along the base body. The pressing means, which provides a spring force, of the pressure tool is pushed into the interior of the ink cartridge (merely called "cartridge") so that the pressing means presses the spring means installed in the ink reservoir of the cartridge so as to compress the spring means; and upon the completion of the ink refill which is performed through an ink filling aperture of the cartridge, the aperture is closed, and the pressing means is removed from the cartridge, thus allowing the spring means to expand inside the ink reservoir by its own expanding force and create a negative pressure inside the ink reservoir.

Furthermore, the object of the present invention is accomplished by an ink refilling kit that includes an opening tool and an ink refilling adapter along with the pressure tool described above. The opening tool has at its one end a pointed end for creating an interior access to the cartridge so that the pressing means of the pressure tool is pushed into the cartridge through the interior access. The ink refilling adapter has an ink conduit that is engageable with the ink filling aperture of the cartridge so that refilling ink can be transferred from an ink supply container into the cartridge through the ink conduit while the spring means inside the ink reservoir of the cartridge is being compressed by the pressing means of the pressure tool. After finishing the refill of the ink reservoir with the ink from the ink supply container, the ink fill aperture is closed by a replacement plug formed at another end of the opening tool; and then, the pressing means is removed from the cartridge, thus allowing a negative pressure to be produced inside the ink reservoir by the expanding spring means installed inside the reservoir.

In addition, the object of the present invention is accomplished by a unique method that comprises the steps of forming an access to the interior of an ink cartridge, inserting a pressing means of a pressure tool into the interior of the ink cartridge so as to compress a spring means installed in the ink reservoir of the ink cartridge, opening an ink filling aperture of the ink cartridge, setting an ink refilling adapter on the ink cartridge so that an ink supply container is connected to the ink refilling adapter thus transferring ink in the ink supply container into the ink reservoir of the ink cartridge through the ink refilling adapter, removing the ink refilling adapter from the ink cartridge, closing the ink filling aperture, and then removing the pressing means from the ink cartridge thus allowing the spring means installed in the ink reservoir of the ink cartridge to expand and generate a negative pressure inside the ink reservoir.

BRIEF DESCRIPTION OF THE DRAWINGS

FIG. 3(*d*) shows an enlarged cross section of the ink conduit of the ink refilling adapter taken along the lines 3*d*—3*d* in FIG. 3(*b*);

DETAILED DESCRIPTION OF THE INVENTION

The method, apparatus and a kit for refilling an ink cartridge (merely called "cartridge") according to the present invention includes an opening tool 10, a pressure tool 20 and an ink refilling adapter 30.

Figure 1:
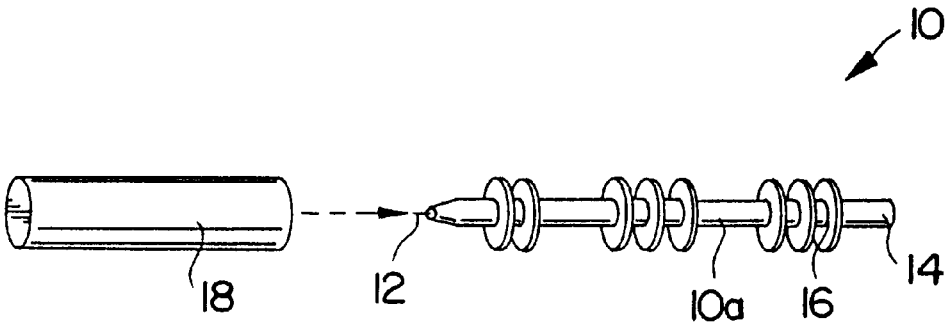
FIG. 1 shows a perspective view of an opening device used in the present invention.

The opening tool 10, as shown in FIG. 1, is comprised of an elongated main body 10*a* which is made of plastic and a metal needle 12 securely connected to one end of the main body 10*a*. The main body 10*a* also has a replacement plug 14 at another end thereof The replacement plug 14 is formed integral to the main body 10*a* with a connecting section 16 in between so that the replacement plug 14 can be separated from the main body 10*a* at the connecting section 16, thus closing the ink filling aperture of an ink cartridge as described below. The needle 12 can be covered by a protective 6(*a*) cap 18.

Figure 2A:
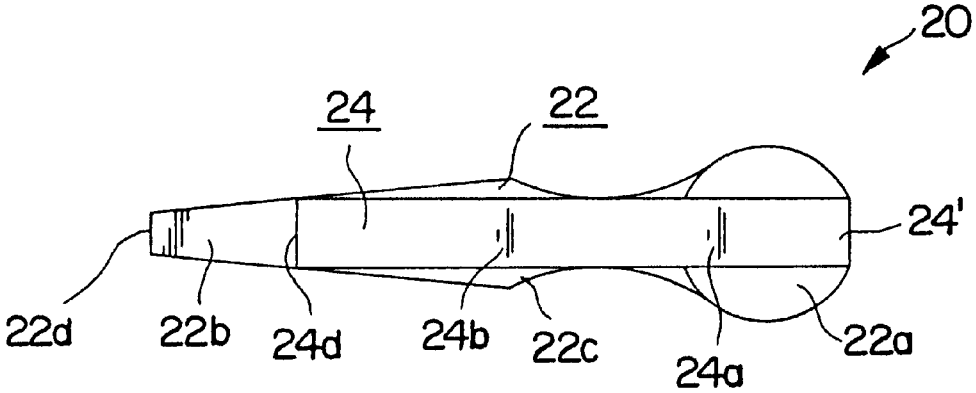
FIGS. 2(*a*) and 2(*b*) show a top view and a side view, respectively, of an pressure tool used in the present invention.
Figure 2B:
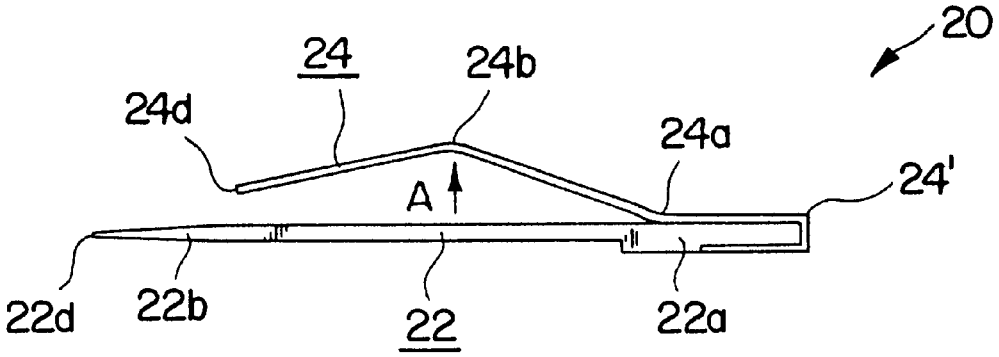
Figure 3A:
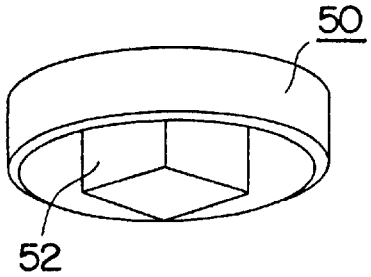
FIGS. 3(*a*), 3(*b*) and 3(*c*) show a safety cap, an ink refilling adapter in partially cross section, and a top view of the ink refilling adapter, respectively, used in the present invention.
Figure 3B:
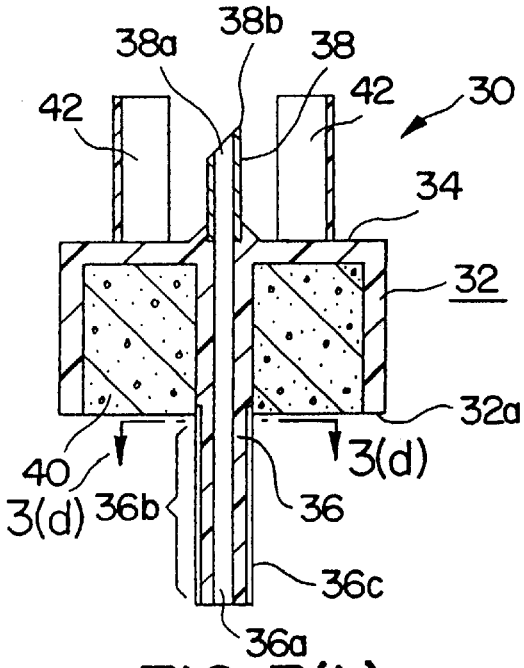
Figure 3C:
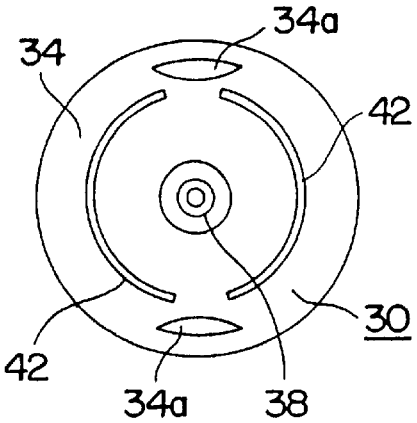
Figure 3D:
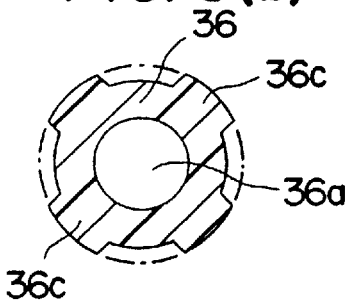

FIGS. 2(*a*) and 2(*b*) show the pressure tool 20 which comprises a plastic handle 22 and an elastic metal tongue 24. The plastic handle 22 is a flat, elongated body that has a grip section 22*a* at one end thereof and a head section 22*b* at another end thereof with a middle portion 22*c* in between. The grip section 22*a* is typically round and has an appropriate thickness so as to be easily held by the fingers of a user. The head section 22*b* has substantially an arrow-shape (FIG. 2(*a*)) and is tapered (FIG. 2(*b*)), thus having a narrowed thin edge 22*d* so that the head section 22*b* can be used as a guide and as a means for enlarging an interior access slit of the cartridge as described below.

The elastic metal tongue 24 of the pressure tool 20 has substantially the same width as the plastic handle 22 thus having a strip shape and is fastened at its one (root) end to the grip section 22*a* of the handle 22. Typically, the base end 24' of the metal tongue 24 is formed into an angled C and tightly fitted on the grip section 22*a* of the handle 22, thus making a single body with the handle 22. The metal tongue 24 is bent at two points 24*a* and 24*b* by obtuse angles. As best seen from FIG. 2(*b*), at a first point 24*a*, the metal tongue 24 is bent so as to extend away from the handle 22; and at a second point 24*b*, the metal tongue 24 is bent so as to extend towards the thin edge 22*d* of the handle 22. The free end portion 24*d* of the metal tongue 24 inclines towards the head section 22*b* of the handle 22 with a space in between. Accordingly, as seen from FIG. 2(*b*), the elastic metal tongue 24 is shaped into an inverted V with reference to the handle 22 so that the metal tongue 24 exerts a spring force in the direction of arrow A when pressed towards the handle 22.

The ink refilling adapter 30, as shown in FIG. 3(*b*), comprises a cylindrical skirt body 32 that has a round top plate 34 and is obtained from a plastic, etc. An ink transfer conduit 36 is axially formed at the center of the cylindrical skirt body 32 and has an ink passage bore 36*a* that extends throughout the length of the ink transfer conduit 36 so that the upper end of the ink passage bore 36*a* opens in the top plate 34. A metal pipe 38 that has an ink passage bore 38*a* and a sharp pointed end 38*b* is securely fixed to the top plate 34 so that the ink passage bore 38*a* is connected to the opened upper end of the ink passage bore 36*a* of the ink transfer conduit 36. The ink passage bore 36*a* of the conduit 36 and the ink passage bore 38*a* thus communicate with each other, and the metal pipe 38 and the ink transfer conduit 36 that have communicated bores 38*a* and 36*a* form an ink conduit. The ink transfer conduit 36 has a length greater than the height of the skirt body 32, thus extending beyond an edge 32*a* of the skirt body 32 so that the lower portion 36*b* can, as will be described below, be brought into the ink filling aperture of an ink cartridge.

The lower portion 36*b*, as shown in FIG. 3(*d*), is provided with a plurality of longitudinal ribs 36*c*. These ribs 36*c* are formed on the outer surface of the lower portion 36*b* of the conduit 36 so as to extend in the axial direction of the conduit 36 and to be circumferentially at regular intervals, thus forming empty spaces between the ribs 36*c*. The outer diameter which is obtained by the imaginary line connecting the outer surfaces of the longitudinal ribs 36*c* is slightly larger than the inner diameter of the ink filling aperture 120 so that the ink transfer conduit 36, particularly the lower portion 36*b* thereof, is pushed into the ink filling aperture of an ink cartridge and held elastically tight by the ink filling aperture.

In addition, the top plate 34 is provided with windows 34*a* which are opened in diametrically opposite locations near the outer edge of the top plate 34. Each of the windows 34*a* is formed in an arc shape but can be in any shape and can be opened at any location in the top plate 34.

In addition, an ink absorbing pad 40 is provided inside the skirt body 32 so as to fill the inside of the skirt body 32 so as to show through the windows 34*a* formed in the top plate 34 and surround the ink transfer conduit 36. The ink absorbing pad 40 is obtained from a material such as a cotton, urethane, etc. which is hardened and shaped into a cubic or cylinder so as to not only absorb ink but also stabilize the ink refilling adapter 30 on the cartridge when it is placed thereon during the ink refill process. When an ink overflow occurs during the ink refill process described below, the overflowing ink is absorbed by the ink absorbing pad 40 so that such an absorbed ink can be seen through the windows 34*a*. Thus, the ink absorbing pad 40 and the indication windows 34*a* form an ink overflow indicating means that allows the user to stop the ink refill process. Instead of providing the windows 34*a*, the top plate 34 can be made transparent so that the overflowing ink absorbed by the ink absorbing pad 40 can be seen therethrough.

The ink refilling adapter 30 further includes a pair of arc-shaped guide collars 42 formed on the outer surface of the round top plate 34 so as to surround the metal pipe 38 with a space in between as shown in FIG. 3(*c*). The guide collars 42 are slightly higher than the metal pipe 38. The thus formed guide collars 42 guide and hold the neck portion of an ink supply container during the ink refill process and also protect the fingers of the user from the pointed end 38*b* of the metal pipe 38. Typically, the ink transfer conduit 36, the metal pipe 38 and the guide collars 42 are provided so as to be perpendicular to the top plate 34 of the skirt body 32.

The guide collars 42 can be covered by a safety cap 50 which is shown in FIG. 3(*a*) so as to prevent any danger to users. The safety cap 50 is provided therein with an ink absorbing pad 52. The ink absorbing pad 52 is a cotton, urethane, etc. which is hardened and shaped into, for example, a cubic, cylinder or rectangular form and has a sufficient thickness that covers the upper portion of the metal pipe 38 when the safety cap 50 is placed on the guide collars 42.

Figure 8:
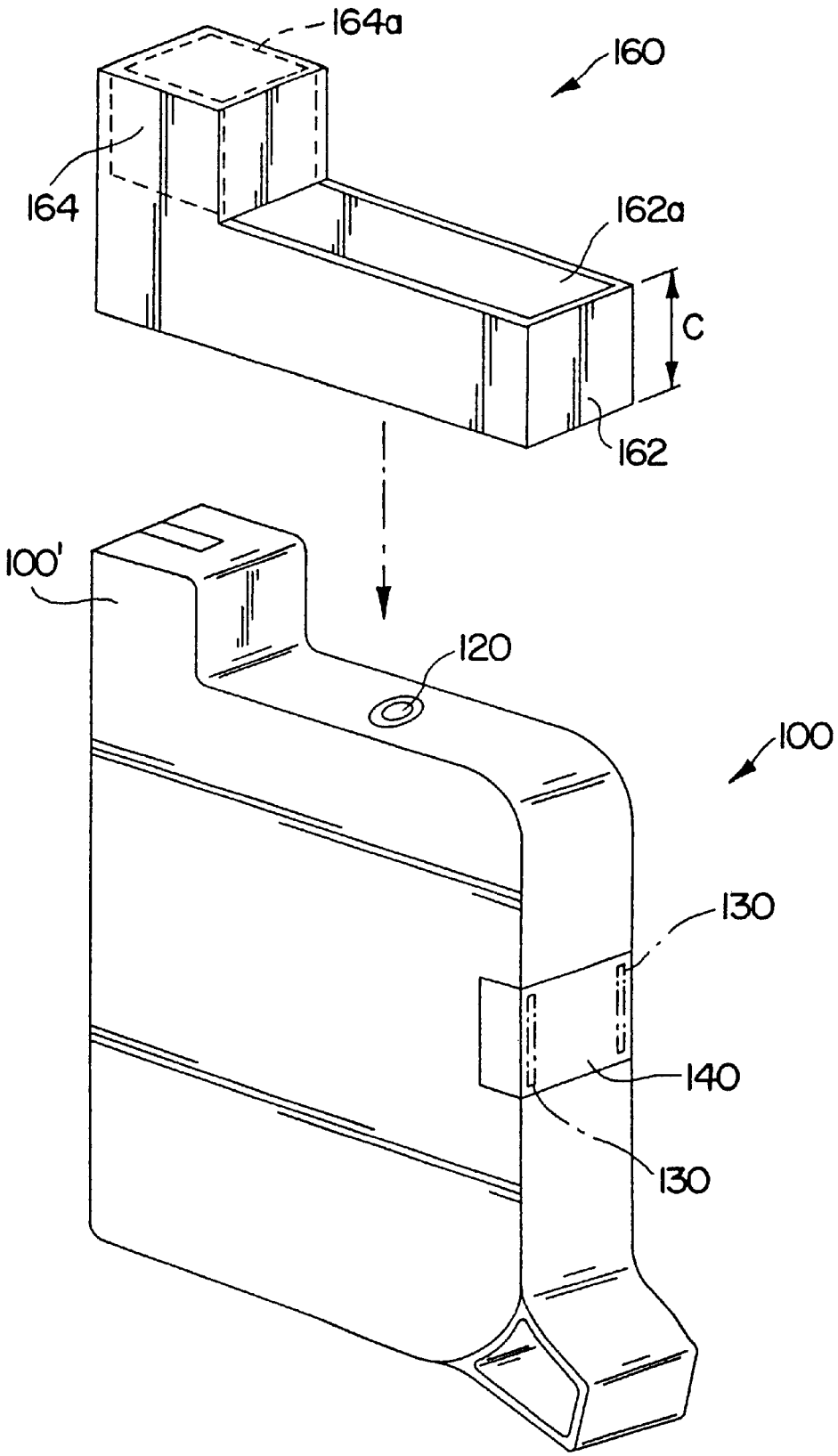
FIG. 8 illustrates a head cover to be placed on an ink cartridge during the ink refill process.
Figure 9:
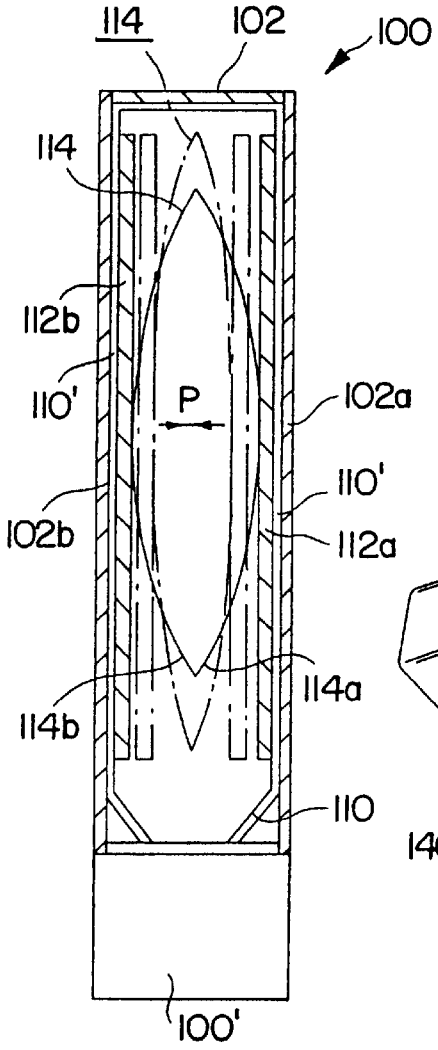
FIG.9 PRIOR ART
FIG. 9 shows an interior of a typical ink cartridge which includes a spring means and upon which the present invention is utilized.
Figure 10:
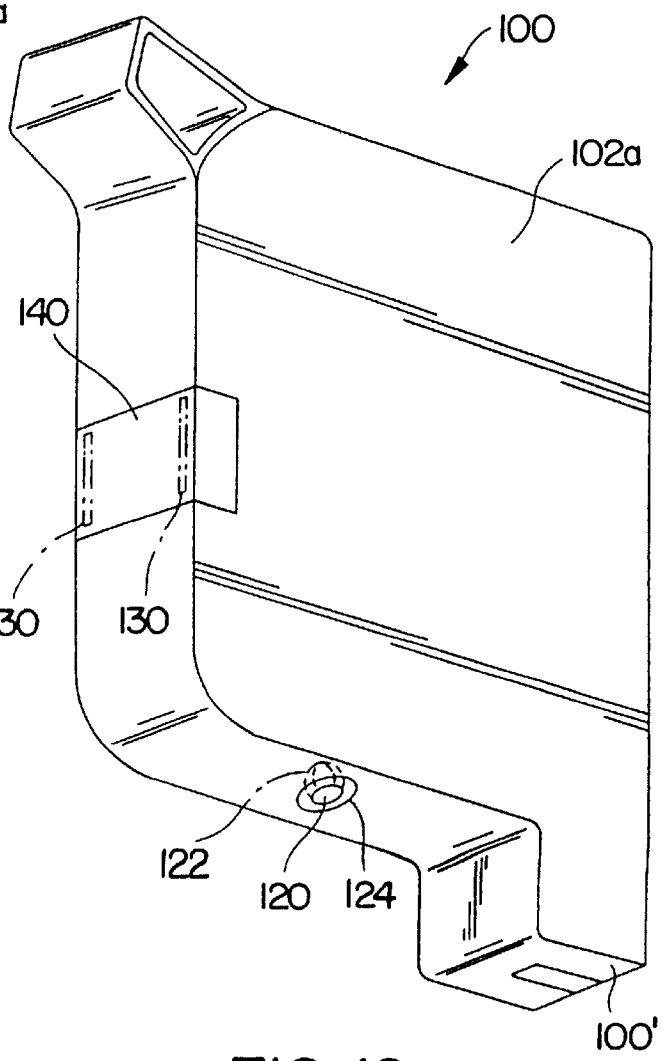
FIG. 10 PRIOR ART
FIG. 10 shows an exterior of the ink cartridge shown in FIG. 9.

When the ink cartridge 100 as described above needs to be refilled with ink, the cartridge 100 is removed from a printer and held upright with the ink filling aperture 120 face up as shown in FIG. 8 by hand or using an appropriate ink cartridge holding device. Since the ink inside the ink reservoir 110 of the cartridge 100 has been fully used and the ink reservoir 110 is empty, the ink reservoir 110 takes on a deflated shape as shown by the dotted lines in FIG. 9.

Figure 4:
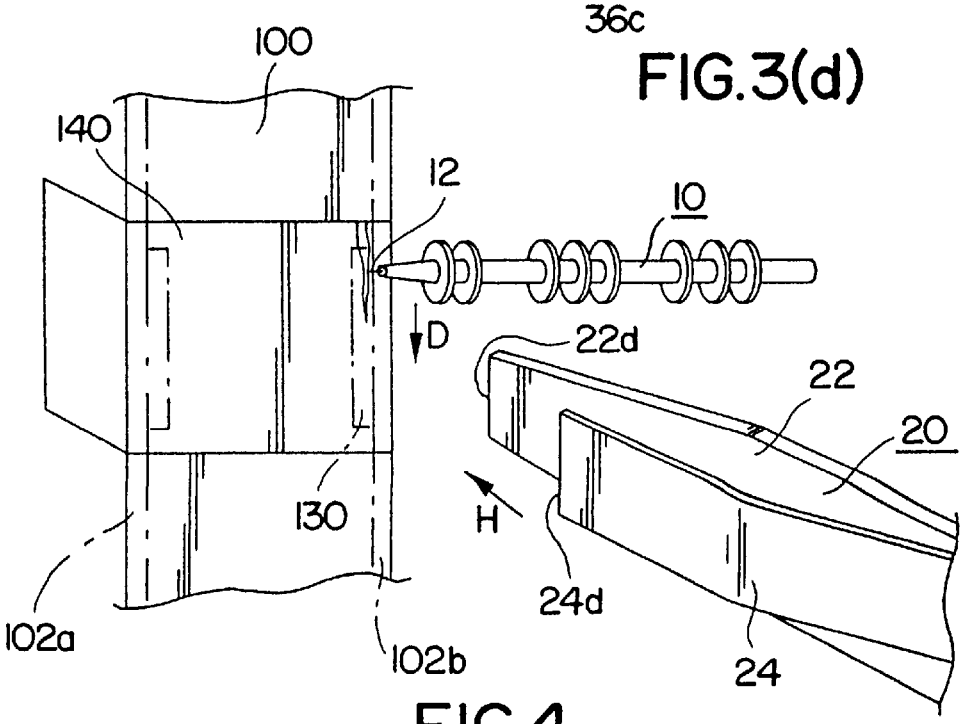
FIG. 4 is a partial perspective view showing the various steps taken in the ink refill process of in the present invention.

First, as shown in FIG. 4, the covering seal 140 (and the ink amount indicating tape) is first cut using the opening tool 10. The pointed end 12 of the opening tool 10 is placed on a portion of the covering seal 140 which is near one of two side coverings (the covering 102*b* in the shown embodiment) of the cartridge 100, slightly pushed by the hand towards inside of the cartridge 100 and then moved downward in the direction of arrow D so that the covering seal 140 (together with the ink amount indicating tape) are cut or partially removed. When the covering seal 140 (and the ink amount indicating tape) are thus partially removed, the interior access slit 130 is revealed.

Figure 5:
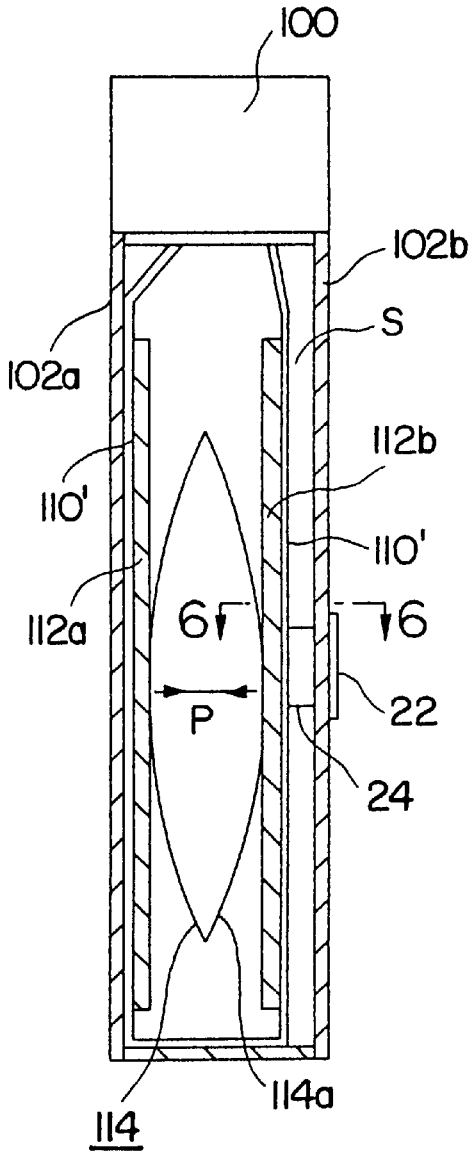
FIG. 5 shows a cross section of an ink cartridge with the pressing means of the pressure tool inserted in the ink cartridge during the ink refill process.

Next, the thin edge 22*d* of the handle 22 of the pressure tool 20 is brought by hand on the outer surface of the side covering 102*b* which is next to the interior access slit 130, and then the handle 22 is moved in the direction of the inside of the cartridge 100 as shown by arrow H. In this case, the thin edge 22*d* of the handle 22 of the pressure tool 20 being in contact with the outer surface of the side covering 102*b* advances as a guide, and then the free end portion 24*d* of the metal tongue 24 is pushed into the access slit 130. Since the free end portion 24*d* of the metal tongue 24 inclines towards the handle 22 of the pressure tool 20, the free end portion 24*d* comes into contact with the inner surface of the side covering 102*b* by being pressed by the edges that define the access slit 130. By being pushed further, the metal tongue 24 of the pressure tool 20 advances into the space S between the side covering 102*b* of the cartridge 100 and the ink reservoir bag 110' as shown in FIG. 5. In this inserting process, the metal tongue 24 is stretched out by the edges of the access slit 130; and then, when the metal tongue 24 is entirely pushed inside the cartridge 100 or the space S, it regains its original inverted V-shape.

When the access slit 130 is too small (in width) for the metal tongue 24 to pass through, then the access slit 130 can be enlarged (or widened) by inserting therein the narrowed thin edge 22*d* and further the head section 22*b* of the handle 22.

The closing seal 124 on the cartridge 100 is next removed using the pointed end 12 of the opening tool 10.

Then, the ink refilling adapter 30 is set on the cartridge 100. More specifically, the lower end of the ink transfer conduit 36 is positioned on the metal ball 122 set in the ink filling aperture 120, and then the adapter 30 is pressed towards the inside of the cartridge 100. As a result, the metal ball 122 is removed from the ink fill aperture 120 and falls inside the cartridge 100.

Figure 6:
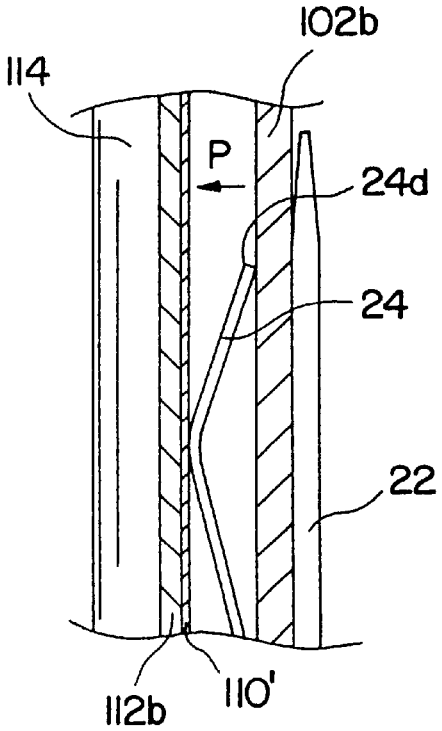
FIG. 6 shows an enlarged cross section taken along the lines 6—6 in FIG. 5.

When the refilling adapter 30 is further pushed in, the ink passage bore 36*a* of the ink transfer conduit 36 of the refilling adapter 30 is connected to and communicates with the ink reservoir 110, thus allowing the exterior air to flow into the ink reservoir 110. With this air flown into the ink reservoir 110 that equals the pressure inside the ink reservoir 110 to the pressure outside the cartridge 100, the spring means 114 expands until one side plate 112*a* being pressed by the spring means 114 comes into contact with the inner surface of the side covering 102*a* of the cartridge 100 (with the ink reservoir bag 110' in between) and another side plate 112*b* comes into contact with the metal tongue 24 (with the ink reservoir bag 110' in between) as shown in FIGS. 5 and 6. In other words, because of the inverted V-shaped metal tongue 24 which occupies a certain amount of inside space of the cartridge 100, the expansion of the spring means 114 is restrained by the metal tongue 24, and the spring means 114 expands only until it receives a compression force from the metal tongue 24 of the pressure tool 20. Thus, the side plate 112*b* of the ink reservoir 110 are not in contact (with the ink reservoir bag 110' in between) with the inner surface of the side covering 102*b* of the cartridge 100.

Figure 7:
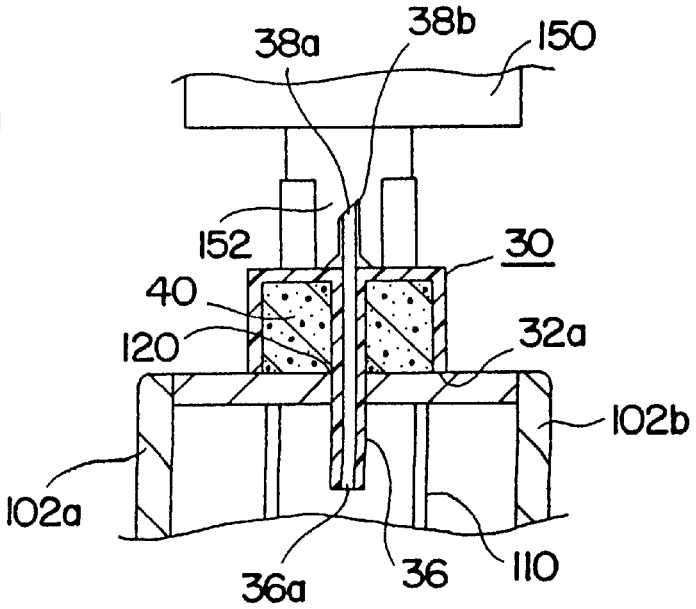
FIG. 7 illustrates the ink refilling adapter in cross section set on the ink cartridge in cross section with an ink supply container connected to the ink refilling adapter.

When, as described above, the conduit 36 of the ink refilling adapter 30 is pushed into the cartridge 100 through the ink fill aperture 120, the lower edge 32*a* of the skirt body 32 and the lower surface of the ink absorbing pad 40 come into contact with the upper surface of the cartridge 100 (see FIG. 7). Thus, by way of such a contact of the edge 32*a* of the skirt body 32 and of the bottom surface of the ink absorption pad 40 with the upper surface of the cartridge 100 and further by way of an engagement between the outer surface of the longitudinal ribs 36*c* of the lower portion 36*b* of the ink transfer conduit 36 and the ink filling aperture 120 of the cartridge 100, the ink refilling adapter 30 can be seated on the cartridge 100 as shown in FIG. 7 securely.

Then, the protective cap 50 of the ink refilling adapter 30 is removed, and an ink supply container 150 is connected to the ink refilling adapter 30 via the metal pipe 38 thereof as shown in FIG. 7. The pointed end 38*b* of the metal pipe 38 penetrates into the neck portion 152 of the ink supply container 150 so that the ink supply container 150 is coupled to the ink refilling adapter 30. The ink inside the ink supply container 150 is transferred into the ink reservoir 110 of the cartridge 100 through the ink passage bore 38*a* of the metal pipe 38 and then the ink passage bore 36*a* of the ink transfer conduit 36.

During this ink transferring step, since the lower portion 36*b* of the conduit 36 is engaged with the ink fill aperture 120 with the longitudinal ribs 36*c* formed on the outer surface of the lower portion 36*b*, the air inside the ink reservoir 110 escapes through the empty spaces between the ribs 36*b* as the ink is gradually refilled inside the ink reservoir 110 and then through the windows 34*a* of the top plate 34 of the ink refilling adapter 30. The air inside the ink reservoir can escape through a small space between the ink refilling adapter 30 and the ink cartridge 100. Thus, the ink refill process can be performed smoothly.

After a predetermined amount of ink has thus been transferred, the ink supply container 150 is detached from the ink refilling adapter 30. During the ink transferring step described above, when the ink reservoir 110 is filled and ink flows out of the aperture 120 of the cartridge, such an overflow of the ink is absorbed by the ink absorbing pad 40, and the absorbed ink can be seen through the windows 34*a* (or through the transparent top plate 34) of the ink refilling adapter 30. Thus, it is possible to immediately stop the ink refill process.

Then, the safety cap 50 is put back on the guide collars 42 of the ink refilling adapter 30, and the ink refilling adapter 30 is removed from the cartridge 100. When the safety cap 50 is put back on the guide collars 42, the metal pipe 38 pierces into the ink absorbing pad 52 by way of the pointed end 38*a*. As a result, ink remaining inside the ink passage bores 36*a* and 38*a* is absorbed by the ink absorbing pad 52, and ink is prevented from spilling when the adapter 30 is removed from the cartridge 100.

The replacement plug 14 of the opening tool 10 is next inserted into the ink filling aperture 120 of the cartridge 100, and then the plug 14 is separated from the elongated main body 10*a* of the opening tool 10, thus closing the ink fill aperture 10 (The replacement plug 14 can be first removed from the main body 10*a* and then pushed into the ink filling aperture 120).

After the ink filling aperture 120 is thus closed, the pressure tool 20 is removed from the cartridge 100. In other words, the metal tongue 24 of the pressure tool 20 is pulled out through the interior access slit 130; and when the metal tongue 24 is thus removed, the contact between the metal tongue 24 and the side plate 112*b* (with the ink reservoir bag 110' in between) of the ink reservoir 110 is released. As a result, the compression force in the direction of arrow P shown in FIG. 5 that has been applied by the metal tongue 24 of the pressure tool 20 against the spring means 114 in the ink reservoir 110 is released, and the compressed spring means 114 expands, thus pushing the side plate 112*b* (with the ink reservoir bag 110' in between) against the side covering 102*b* of the cartridge 100. As a result, the spring means 114 generates a negative pressure inside the ink reservoir 110 which is refilled with ink.

The ink refill process is thus completed, and the cartridge 100 is ready to be installed back into a printer.

In the above description, the metal tongue 24 of the pressure tool 20 is pushed into the cartridge 100 before the metal ball 122 is removed. However, the metal tongue 24 can be pushed into the cartridge 100 after the metal ball 122 has been removed.

In this case, upon the removal of the metal ball 122, the exterior air comes into the ink reservoir 110, thus letting the spring means 114 expand so that both side plates 112*a* and 112*b* of the ink reservoir 110 come into contact with the inner surfaces of the side coverings 102*a* and 102*b* of the cartridge 100 (with the ink reservoir bag 110' in between). The metal tongue 24 of the pressure tool 20 is then inserted into the cartridge 110 through the access slit 130 such that the metal tongue 24 thrusts between the ink reservoir bag 110' and the inner surface of the side covering 102*b* of the cartridge 100. As a result, the inverted V-shaped metal tongue 24, overcoming the spring force of the spring means 114, presses the spring means 114 of the ink reservoir 110 through the side plate 112*b* (with the ink reservoir bag 110' in between) in the direction of arrow P (see FIG. 5), thus compressing the spring means 114.

Afterward, as in the same manner as described above, the ink is filled in the ink reservoir 110 while the spring means 114 is being compressed, and the metal tongue 24 of the pressure tool 20 is removed from the cartridge 100 upon completion of the ink transfer, allowing the spring means 114 to expand so as to generate a negative pressure inside the ink reservoir 110 which is refilled with ink.

Typically, the metal tongue 24 of the pressure tool 20 is designed so as to apply a pressure that allows the ink reservoir to contain 3 grams of ink less than the maximum possible capacity of the ink reservoir so that the spring means 114 generates a negative pressure which is substantially equal to the volume of 3 grams of ink. Thus, the metal tongue 24 has a spring force which is greater than the spring force of the spring means 114 so that the metal tongue 24 is not pressed flat by the spring means 114.

In the above embodiment, the metal tongue 24 is shaped in an inverted V, but it can be arc-shaped or in any other shape that can compress the spring means 114 during the ink refill process. In addition, the pressure tool 20 has the metal tongue 24 as a means for applying a compression force on the spring means 114. However, the means for applying the compression force is not limited to be made of metal and can be made from plastic, sintered material, etc, which has an elasticity.

Furthermore, a head cover 160 as shown in FIG. 8 can be used in the ink refill process described above. The head cover 160 is for preventing ink spillage that could occur during the ink refill process and for protecting the head part 100' of the cartridge 100.

The head cover 160 is comprised of a rectangular parallelepiped enclosure section 162 and a substantially cubic box section 164 formed at one end of the enclosure section 162. The enclosure section 162 has an open top 162*a* and has a height C that can enclose about the upper ¼ of the cartridge 100 when the cartridge 100 is held upright as shown in FIG. 8. In addition, the cubic box section 164 is provided with an ink absorbing pad 164*a* which covers the inner surface thereof.

The head cover 160 is placed on the cartridge 100 such that the box section 164 covers the head part 100' and the enclosure section 162 allows the closing seal 124 on the ink filling aperture 120 to be exposed through the open top 162*a*. Preferably, the head cover 160 is used in the first step of the ink refill process, even before the covering seal 140 is removed by the opening tool 10. Since the box section 164 of the head cover 160 is provided therein with the ink absorbing pad 164*a* and placed on the head part 100' of the cartridge, the pad 164*a* absorbs ink that oozed out from and is around the head part 100', thus protecting the head part and also preventing the head part from drying.

As seen from the above, since the negative pressure can be generated by the spring means inside the ink reservoir when the ink refill process completed, the refilled ink is prevented from leaking out of the head part of the ink cartridge.

What is claimed is:

1. A method for refilling an ink cartridge, said ink cartridge being provided with an ink filling aperture closed by a closing means, an interior access opening covered by a covering seal, an ink reservoir installed inside said ink cartridge, and a spring means installed in said ink reservoir for generating a negative pressure inside said ink reservoir, said method comprising the steps of:

removing said covering seal so as to reveal said interior access opening of said ink cartridge;

inserting a means for exerting a compression force into an interior of said cartridge through said interior access opening;

removing said closing means from said ink filling aperture of said ink cartridge so as to open said ink filling aperture into said ink reservoir to equalize a pressure in said ink reservoir, thus allowing said spring means to expand until said spring means receives a compression force from said means for exerting a compression force;

refilling said ink reservoir of said ink cartridge through said ink filling aperture;

closing said ink filling aperture of said ink cartridge; and removing said means for exerting a compression force out of said interior of said ink cartridge, thus releasing said compression force on said spring means so that said spring means further expands and generates a negative pressure in said ink reservoir.

2. A method for refilling an ink cartridge, said ink cartridge being provided with an ink filling aperture closed by a closing means, an interior access opening covered by a covering seal, an ink reservoir inside said ink cartridge, and a spring means installed in said ink reservoir for generating a negative pressure inside said ink reservoir, said method comprising the steps of:

removing said covering seal so as to reveal said interior access opening of said ink cartridge;

removing said closing means from said ink filling aperture of said ink cartridge so as to open said ink filling aperture into said ink reservoir to equalize a pressure in said ink reservoir, thus allowing said spring means to expand;

inserting a means for exerting a compression force into an interior of said cartridge through said interior access opening, thus compressing said spring means by said means for exerting a compression force;

refilling said ink reservoir of said ink cartridge through said ink filling aperture;

closing said ink filling aperture of said ink cartridge; and removing said means for exerting a compression force out of said interior of said cartridge, thus releasing said compression on said spring means so that said spring means expands and generates a negative pressure in said ink reservoir.

3. A method for refilling ink using an ink refilling kit that comprises an opening device having at one end thereof a metal needle with a pointed end and at another end thereof a replacement plug, a pressure device having a pressing means, and an ink refilling device having an ink conduit which at one end thereof is adapted to be connected to an ink supply container and another end thereof is adapted to be introduced into an ink reservoir of an ink cartridge, said ink cartridge being provided with an ink filling aperture closed by a closing means, which is covered by a closing seal, an interior access opening covered by a covering seal, and a spring means installed in said ink reservoir for generating a negative pressure inside said ink reservoir, said method comprising the steps of:

removing said covering seal by said pointed end of said metal needle of said opening device so as to reveal said interior access opening;

inserting said pressing means of said pressure device into an interior of said cartridge through said interior access opening;

removing said closing seal by said pointed end of said metal needle of said opening device;

removing said closing means from said ink filling aperture using said another end of said ink conduit of said ink refilling device so as to open said ink filling aperture of said ink cartridge into said ink reservoir to equalize a pressure in said ink reservoir, thus allowing said spring means to expand until said spring means receives a compression from said pressure device;

inserting said another end of said ink conduit of said ink refilling device into said ink cartridge so that said another end of said ink conduit communicates with said ink reservoir;

connecting said ink supply container to said one end of said ink conduit of said ink refilling device so that ink in said ink supply container is transferred into said ink reservoir through said ink conduit;

removing, upon filling said ink reservoir with ink from said ink supply container, said ink refilling device from said ink cartridge so as to disengage said communication between said ink conduit of said ink refilling device and said ink reservoir of said ink container;

closing said ink filling aperture of said ink cartridge with said replacement plug of said opening device; and removing said pressing means of said pressure device out of said interior of said cartridge so as to release said compression on said spring means, thus allowing said spring means to further expand and generate a negative pressure in said ink reservoir.

4. A method according to claim 3, further comprising a step of placing a head cover on said ink cartridge before said step of removing said covering seal.

5. A method for refilling ink using an ink refilling kit that comprises an opening device having at one end thereof a metal needle with a pointed end and at another end thereof a replacement plug, a pressure device having a pressing means thereon, and an ink refilling device having an ink conduit which at one end thereof is adapted to be connected to an ink supply container and another end thereof is adapted to be introduced into an ink reservoir of an ink cartridge, said ink cartridge being provided with an ink filling aperture closed by a closing means, which is covered by a closing seal, an interior access opening covered by a covering seal, and a spring means installed in said ink reservoir for generating a negative pressure inside said ink reservoir, said method comprising the steps of:

removing said covering seal by said pointed end of said metal needle of said opening device so as to reveal said interior access opening;

removing said closing seal by said pointed end of said metal needle of said opening device;

removing said closing means from said ink filling aperture using said another end of said ink conduit of said ink refilling device so as to open said ink filling aperture of said ink cartridge into said ink reservoir to equalize a pressure in said ink reservoir, thus allowing said spring means to expand;

inserting said another end of said ink conduit of said ink refilling device into said ink cartridge so that said another end of said ink conduit communicates with said ink reservoir;

inserting said pressing means of said pressure device into an interior of said cartridge through said interior access opening so as to apply thereby a compression onto said spring means;

connecting said ink supply container to said one end of said ink conduit of said ink refilling device so that ink in said ink supply container is transferred into said ink reservoir through said ink conduit;

removing, upon filling said ink reservoir with ink from said ink supply container, said ink refilling device from said ink cartridge so as to disengage said communication between said ink conduit of said ink refilling device and said ink reservoir of said ink container;

closing said ink filling aperture of said ink cartridge with said replacement plug of said opening device; and removing said pressing means of said pressure device out of said interior of said cartridge so as to release said compression on said spring means, thus allowing said spring means to expand and generate a negative pressure in said ink reservoir.

6. A method according to claim 5, further comprising a step of placing a head cover on said ink cartridge before said step of removing said covering seal.

* * * * *